US009493998B2

(12) United States Patent
Machocki

(10) Patent No.: US 9,493,998 B2
(45) Date of Patent: Nov. 15, 2016

(54) DRILL STRING TUBULAR COMPONENT

(75) Inventor: Krzysztof Machocki, Aberdeen (GB)

(73) Assignee: Oilsco Technologies Limited, Aberdeen (GB)

( * ) Notice: Subject to any disclaimer, the term of this patent is extended or adjusted under 35 U.S.C. 154(b) by 123 days.

(21) Appl. No.: 14/348,510

(22) PCT Filed: Sep. 7, 2012

(86) PCT No.: PCT/GB2012/052200

§ 371 (c)(1),
(2), (4) Date: May 8, 2014

(87) PCT Pub. No.: WO2013/034919

PCT Pub. Date: Mar. 14, 2013

(65) Prior Publication Data

US 2014/0299380 A1 Oct. 9, 2014

(30) Foreign Application Priority Data

Sep. 7, 2011 (GB) ..... 11154598

(51) Int. Cl.
*E21B 21/00* (2006.01)
*E21B 37/00* (2006.01)
(Continued)

(52) U.S. Cl.
CPC ..... *E21B 21/00* (2013.01); *E21B 17/1078* (2013.01); *E21B 17/22* (2013.01); *E21B 37/00* (2013.01)

(58) Field of Classification Search
CPC ..... E21B 37/00; E21B 17/22; E21B 17/1078; E21B 21/00
See application file for complete search history.

(56) References Cited

U.S. PATENT DOCUMENTS 2,794,617 A * 6/1957 Yancey ..... E21B 21/00 175/323
3,420,323 A * 1/1969 Owens ..... E21B 17/1078 175/323

(Continued)

FOREIGN PATENT DOCUMENTS

GB 2473094 A 3/2011
WO 2013034919 A2 3/2013

OTHER PUBLICATIONS

PCT/GB2012/052200 International Search Report and Written Opinion, Mailed Feb. 5, 2014, 11 pages.

(Continued)

*Primary Examiner* — Shane Bomar
(74) *Attorney, Agent, or Firm* — Dennis A. Bennett; Chris Marion

(57) ABSTRACT

A drill string tubular component for use in an oil or gas well, in the form of a tubular having a central bore and a mechanism for mobilizing drill cuttings comprising at least one radial impeller (30) configured to apply radial thrust cuttings passing it, the radial impeller being located between first and second axial impellers (10, 20) configured to apply axial thrust to the fluids in opposite directions. Typically helical components of the first and second axial impellers extend in respective opposite directions, typically toward the radial impeller. Fluids are thus diverted radially away from the outer surface of the tubular component, and thereby enter a more turbulent region of the annulus, there reducing the tendency of the drill cuttings to settle out of suspension.

21 Claims, 6 Drawing Sheets

(51) Int. Cl.
*E21B 17/10* (2006.01)
*E21B 17/22* (2006.01)

(56) References Cited

U.S. PATENT DOCUMENTS 6,223,840 B1 * 5/2001 Swietlik ..... E21B 17/10 166/173
6,227,291 B1 * 5/2001 Carmichael ..... E21B 37/02 166/170
6,308,780 B1 * 10/2001 Efimkin ..... E21B 21/00 166/173
6,575,239 B2 * 6/2003 Allen ..... F16L 45/00 15/104.09
6,732,821 B2 * 5/2004 Boulet ..... E21B 17/22 175/323
7,137,449 B2 * 11/2006 Silguero ..... E21B 37/00 166/301
7,455,113 B2 * 11/2008 Booth ..... E21B 17/22 166/173
8,141,627 B2 * 3/2012 Krieg ..... E21B 37/02 166/172
8,336,645 B2 * 12/2012 Robson ..... E21B 17/10 166/241.6
8,678,091 B2 * 3/2014 Nelson ..... E21B 17/1078 166/311
8,905,126 B2 * 12/2014 Krieg ..... E21B 37/00 166/174
9,109,417 B2 * 8/2015 Leiper ..... E21B 37/00
2010/0186962 A1 7/2010 Knobloch et al.
2011/0048803 A1 * 3/2011 Robson ..... E21B 17/10 175/57
2011/0265988 A1 * 11/2011 Hern ..... E21B 37/02 166/173
2011/0284210 A1 * 11/2011 Hern ..... E21B 17/1078 166/99
2011/0285155 A1 * 11/2011 Nelson ..... E21B 17/1078 294/65.5
2014/0000900 A1 * 1/2014 Leiper ..... E21B 37/00 166/311

OTHER PUBLICATIONS

PCT/GB2012/052200 International Preliminary Report on Patentability, Mar. 12, 2014, 8 pages.

* cited by examiner

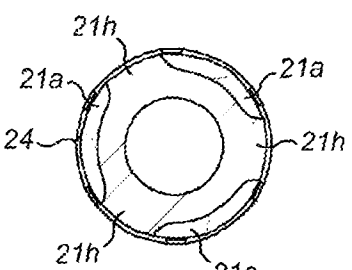
FIG. 3a
FIG. 3b
FIG. 3c
FIG. 3d
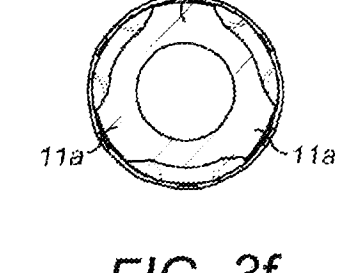
FIG. 3e
FIG. 3f
FIG. 3g
FIG. 3h

DRILL STRING TUBULAR COMPONENT

CROSS REFERENCE TO RELATED APPLICATIONS

This application is a U.S. national stage filing under 35 U.S.C. §371 of PCT International Application No. PCT/GB2012/052200, filed Sep. 7, 2012, which claims the benefit of priority to Great Britain Application No. 1115459.8 filed Sep. 7, 2011. Each of the above-referenced applications is expressly incorporated by reference herein its entirety.

The present invention relates to apparatus and a method for mobilising drill cuttings in a wellbore.

In wellbore drilling, a cutting bit is mounted on the end of a drill string comprising lengths of pipe joined end to end. The drill string is typically rotated as a whole from the surface rig to provide the rotation for the bit to cut into the formation. During the drilling process, fragments of rock and earth (drill cuttings) are generated as the bit cuts into the formation. These drill cuttings need to be removed from the interface between the bit and the formation, and transported back to the surface. This is typically achieved by pumping drilling fluid down through the inner hollow bore of the drill string, out through the drill bit and back up the annulus between the string and the hole, suspending the cuttings in the fluid flow, and carrying them away from the drill bit and back to surface, and at the same time lubricating and cooling the drill bit as it cuts into the formation. Settling of drill cuttings out of suspension during their upward transport in the annulus is typically problematic, as this can impede the movement of the drill string and therefore slow or stop the drilling process. This is particularly problematic in deviated wells and in directional drilling operations where the wellbore extends horizontally rather than vertically, and long horizontal sections of thousands of feet in length are common, which suffer from the cuttings tending to settle and accumulate in cuttings beds on the lower side of the wellbore.

Existing measures to keep cuttings in suspension include various designs of impeller attached to the outer surface of the drill string, which rotate with the drill string, and keep the cuttings in suspension.

According to the present invention there is provided a drill string tubular component in the form of a tubular having a central bore extending along an axis of the tubular, and two ends, the tubular component having an end connector at each end for connection of the drill string tubular component into a drill string for use in drilling a wellbore into a formation, the tubular component having a mechanism for mobilising drill cuttings in an oil or gas well, wherein the mechanism comprises:

- at least one radial impeller in the form of a radial projection extending from the tubular component, the radial projection being configured to apply a radial thrust to the flow of cuttings in the drilling fluid passing through the annulus between the tubular and the hole, so that the cuttings passing the radial projection are urged in a radial direction away from the outer surface of the tubular component; and
- first and second axial impellers in the form of radial projections extending radially from the tubular component, the first and second axial impellers being provided at axially spaced apart locations on the tubular component with respect to the radial impeller such that the radial impeller is located axially between the axial impellers, the axial impellers being configured to apply axial thrust to the fluids passing through the annulus between the tubular and the hole, and wherein the direction of axial thrust applied to the fluid by the first axial impeller is opposite to the direction of axial thrust applied to the fluid by the second axial impeller.

Typically the radial impeller can comprise more than one radial projection. In certain embodiments with more than one radial projection, the radial projections can be spaced circumferentially around the axis of the tubular component.

Optionally each axial impeller can comprise more than one radial projection, e.g. 2, 3, 4 or more radial projections can be provided on each axial impeller. In certain axial impellers with more than one radial projection, the radial projections can be spaced circumferentially around the axis of the tubular component, typically aligned with one another at the same axial location along the axis of the tubular component.

The axial impellers can each typically comprise at least one helical part extending helically around the tubular component, typically having more than one helical part per impeller, and optionally the helical parts can typically be spaced circumferentially around the axis of the tubular component, typically aligned with one another at the same axial location along the axis of the tubular component.

Typically the helical components of the axial impellers in the first and second axial impellers extend in respective opposite directions, for example, the helical components on the first axial impeller can extend clockwise, and those on the second axial impeller can extend anti-clockwise, or vice versa.

The invention also provides a method of mobilising drill cuttings in a drilling operation in an oil or gas well, the method comprising incorporating a drill string tubular component into the drill string, the drill string tubular component having a mechanism for mobilising drill cuttings in an oil or gas well, wherein the mechanism comprises:

- at least one radial impeller in the form of a radial projection extending from the drill string tubular component, the radial projection being configured to apply a radial thrust to the flow of cuttings in the drilling fluid passing through the annulus between the tubular component and the hole, so that the cuttings passing the radial projection are urged in a radial direction away from the outer surface of the tubular component,
- first and second axial impellers in the form of radial projections extending radially from the tubular component, the first and second axial impellers being provided at axially spaced apart locations on the tubular component with respect to the radial impeller such that the radial impeller is located axially between the axial impellers;

wherein the method comprises:

- passing fluids past the radial impeller and diverting fluids flowing past the radial impeller radially outwards away from the outer surface of the tubular component; and
- applying axial thrust to the fluids passing through the annulus between the tubular component and the hole by means of the axial impellers, wherein the direction of axial thrust applied to the fluid by the first axial impeller is opposite to the direction of axial thrust applied to the fluid by the second axial impeller.

The radial impeller can optionally have a ramp.

Fluids flowing axially up the annular area between the drill string and the wellbore typically encounter the ramp and are diverted by the ramp radially away from the outer surface of the tubular component. Diverting the fluids radially outward from the outer surface of the tubular component typically moves the fluids into a region of the annulus with more turbulent and/or faster flow. Drill cuttings present in the fluids passing the ramp are therefore also diverted into the turbulent flow regions and their tendency to settle out of suspension is thereby reduced.

Typically the axial impellers urge the fluid toward the radial impeller for diversion in a radial direction away from the axis of the tubular component.

The radial impeller typically has at least one blade that extends radially from a root 31*r* radially close to the outer surface of the tubular component to a typically flat outer edge that is radially spaced from the axis of the tubular. The flat outer edge typically has a larger diameter than the root 31*r*. Optionally more than one blade can be provided. The blade(s) typically define fluid flow channels, typically between adjacent blades, adapted to guide flow of fluids in the annulus between the tubular and the wellbore.

The blade(s) of the radial impeller are typically aligned with the axis of the tubular, and are typically straight. The channels are also typically aligned with the axis of the tubular and the blades, and are also straight. The floor of the channels typically merges into the radially extending walls of the blades.

The side walls of the blades can optionally be composed of flat surfaces near to the outer face, typically extending generally perpendicular to the axis of the tubular. The sides of the blades at the root 31*r* of each blade and the transition between the blade and the floor of the channel can optionally comprise an arcuate surface 31*a* that extends between the generally perpendicular sides of the blades and the floor of the channel, thereby creating a circumferentially facing ramp, typically extending generally perpendicularly with respect to the blades. Typically the ramps on each side of the channel face one another, and optionally face the direction of rotation. Typically fluid passing through the channels between the blades is urged up the ramps in a radial direction by the rotation of the radial impeller along with the rotating drill string to which the tubular is attached, and is thus diverted radially outwards from the axis of the tubular.

Typically the blade can have ramped surfaces on its side faces. Optionally the blade can have ramped surfaces on its uphole and downhole axial faces in addition to or instead of the circumferentially extending side ramps.

Ramps typically have a tapered profile, with a first end having a low radius region close to the nominal outer diameter of the tubular component at that point, so that at the first end, the ramp does not deflect the fluids radially in the annulus, but permits substantially unhindered upward axial fluid flow of all of the fluids flowing up the annulus and onto the ramp. The second end of the ramp typically has a larger diameter than the first end, sufficient to divert the fluids flowing past or over the ramp (typically parallel to the axis of the tubular) radially outward from the axis of the tubular into a region of the annulus that has more turbulent flow than the region of the annulus immediately radially adjacent to the outer surface of the tubular. The second end can have different radial dimensions, dependent on the available annular spacing between the tubular component and the wellbore, which the skilled person will appreciate will be different in various situations, but typically, the ramp has a sufficient radial dimension to be effective to deflect substantially all of the fluids flowing past the ramp into the outer annular spacing between the tubular and the wellbore.

Between the first and second ends of the ramp the diameter of the ramp typically increases gradually. The increase in diameter between the ends of the ramp can be linear or stepped, but it is especially advantageous if the surface of the ramp is a smooth curve rather than a series of steps or a straight line, as the fluid flowing up the ramp is then accelerated radially outward with the highest available energy and is therefore mostly diverted out of the low radius region close to the surface of the tubular, which generally experiences more laminar flow, and into the high flow rate and high turbulence high radius region of the annulus. The ramp surface can be straight or curved.

The ramp surface can have different angles. The ramp can have a shallow angle at its first end, and a steeper angle at its second end, in order to scoop most of the fluids and start urging them radially before increasing the radial thrust applied to the fluids nearer to the second end of the ramp. The transition between the shallow lead in angle of the ramp at the downhole lower end of the ramp and the steeper angle at the uphole end can be a smooth curve or can be an abrupt change in angle occurring at a particular axial point on the ramp, or occurring over a small axial spacing. The shallow lead in angle at the downhole end can be 0-5 degrees, optionally 10-30 degrees. The steeper angle of the ramp surface at the uphole end can be 18-60 degrees.

The radially outermost surface of the blade typically has a plateau region uphole of a downhole end ramp, which can have a different angle, e.g. a flat planar section parallel to the nominal outer surface of the tubular. Optionally the plateau region can be non-parallel to the axis of the tubular T, and can optionally be tapered from a narrower diameter at its downhole end to a slightly larger diameter at its up-hole end. Typically the plateau region has a taper angle of e.g. 1-5 degrees.

Optionally the radial impeller can have more than one ramp. The radial impeller can typically have a downhole axial ramp at a lower end tapering from a low radius to a high radius, and an uphole axial ramp arranged at its uphole end, typically tapering from a high radius to a low radius, optionally back to the nominal radial diameter of the tubular. Optionally the uphole ramp and the downhole ramp can be spaced apart, typically by a plateau region.

The uphole ramp can optionally have the same or a different angle or configuration as the downhole ramp. The uphole ramp typically has a steeper angle than the downhole ramp.

The radial impeller is optionally substantially equidistant from the first and second axial impellers.

The first and second axial impellers on either side of the radial impeller can optionally incorporate ramps (typically on the facing sides of adjacent projections) to impart radial thrust to fluids flowing up the annulus.

The helical parts of the first and second axial impellers typically incorporate radially extending surfaces, typically generally perpendicular to the axis of the tubular and to the nominal outer surface of the tubular, in order to impart axial thrust to the fluids passing them, and to urge the fluids in a direction towards the radial impeller. Typically the helical parts of the first and second axial impellers are located on the outer ends of the first and second axial impellers. Typically the first and second axial impellers have axial parts which are typically provided on the inner facing sides of the projections, and extend directly from the helical parts. Typically on the first and second axial impellers, the respective radial projections define channels between circumferentially adjacent radial projections. Optionally the channels of the first and second axial impellers extend between the helical and axial parts, so that the channel is also partially helical, typically at its outer end, and partially axial, typically at its inner facing end. Accordingly, each channel has a helical outer part and an axial inner part disposed on the inner ends of the first and second axial impellers, closer to the radial impeller, so that fluids passing through the channels are diverted by the outer helical parts, and are urged through the inner axial parts in a generally straight line towards the radial impeller.

The first and second axial impellers therefore both urge the fluids axially towards the radial impeller located between the first and second axial impellers, which thrusts the fluids radially outward into the high flow, high turbulence region of the annulus, thereby keeping the cuttings suspended in the fluids.

Optionally the helical portions extend in straight lines. Optionally the helical portions (or parts of them) could extend in arcs. Typically the helical portions on respective first and second axial impellers urge the fluids in opposite axial directions, typically towards the ramped projection.

Typically the radial and axial impellers are provided on respective collars that are connected to the outer surface of the tubular. Respective collars can be provided for the first and second axial impellers, and for the radial impeller. The impellers (e.g. the collars) can be axially spaced from one another along the length of the tubular, or can be axially adjacent to one another.

Optionally more than one radial projection is provided on each impeller (e.g. on each collar). Typically 2, 3, 4, 5 or more radial projections are provided on each impeller. Typically the radial projections on each of the impellers are provided at the same location (e.g. on the same collar) along the axis of the tubular, and are circumferentially spaced apart (e.g. circumferentially spaced around the collar) around the axis of the tubular.

Typically the first and second axial impellers are generally circumferentially aligned with one another, with the axial portions being typically provided at the same circumferential orientation.

Typically the first and second axial impellers can be axially spaced apart from the radial impeller along the length of the tubular. Alternatively, the first and second axial impellers can be axially adjacent to the radial impeller, with substantially no axial spacing along the tubular on either side of the radial impeller.

Typically the radial impeller is circumferentially staggered out of axial alignment with respect to the first and second axial impellers, so that the channels in the radial impeller typically align with the radial projections on the first and second axial impellers.

Typically the tubular component is incorporated into a drill string and the connections are typically conventional box and pin arrangements suitable for transferring torque encountered in typical drill strings. Typically the tubular is configured to resist and transfer the torque encountered in typical drill strings.

Typically the tubular is incorporated into a bottom hole assembly (BHA), and can comprise sections of heavy weight drill pipe for assembly near to the bit during drilling, but embodiments can alternatively or additionally be incorporated into strings of drill pipe or other tubular above the BHA.

The tubular component can be incorporated as a sub in a drill string, either once, or in multiple locations, which can be randomly or equally spaced along the length of the string. The pattern of axial impeller, radial impeller and axial impeller can repeat once per tubular, or more than once, so that in a single strand of tubular adapted to be made up into a drill string the pattern can optionally repeat, optionally two or more than two repeats per stand of pipe.

Typically the tubular has bearing surfaces optionally comprising hardened materials to bear against the inner surface of the wellbore, and to space the radial projections from the inner surface of the wellbore, so that they are available to rotate with the string and are less prone to being restricted from rotation by snagging on inwardly extending projections on the inner surface of the wellbore. Typically the bearing surfaces are located on collars that are disposed at axially spaced positions on the tubular, and can typically be located at opposite outside ends of the collars bearing the axial impellers. Typically the collars have a larger radial dimension than the axial and radial impellers, and space the radial projections radially away from the inner wall of the wellbore.

Optionally the collars can have helical grooves which can act as an agitator to impart further thrust to the fluids, typically in an axial direction. These grooves could be orientated in either helical direction, and the grooves on each of the collars can optionally be oriented in opposite directions with respect to each other.

In another aspect, the invention provides a drill string tubular component in the form of a tubular having a central bore extending along an axis of the tubular, and two ends, the tubular component having an end connector at each end for connection of the drill string tubular component into a drill string for use in drilling a wellbore into a formation, the tubular component having a mechanism for mobilising drill cuttings in an oil or gas well, wherein the mechanism comprises at least one radial impeller in the form of a radial projection extending from the drill string tubular component, the radial projection being configured to apply a radial thrust to the flow of cuttings in the drilling fluid passing through the annulus between the tubular and the hole, so that the cuttings passing the radial projection are urged in a radial direction away from the outer surface of the tubular component.

In another aspect, the invention also provides a method of mobilising drill cuttings in a drilling operation in an oil or gas well, the method comprising incorporating a drill string tubular component into the drill string, the drill string tubular component having a mechanism for mobilising drill cuttings in an oil or gas well, wherein the mechanism comprises at least one radial impeller in the form of a radial projection extending from the drill string tubular component, the radial projection being configured to apply a radial thrust to the flow of cuttings in the drilling fluid passing through the annulus between the tubular and the hole, so that the cuttings passing the radial projection are urged in a radial direction away from the outer surface of the tubular component, the method comprising passing fluids past the radial impeller, and diverting fluids flowing past the radial impeller radially outwards away from the outer surface of the tubular component.

Embodiments of the invention permit the profile on the outer surface of the tubular to agitate and accelerate drill cuttings into the high annular flow zone. Any proportion of the cuttings that remain in the low annular velocity laminar flow region close to the body of the tubular above the downhole projection will be accelerated axially towards the ramped projection which further accelerates drill cuttings into the high flow radially outside it. Any cuttings that pass the ramped projection and still remain in the lower flow inner layers of the annulus will be accelerated axial back down the hole towards the upper face of the ramped projection by the profile of the uphole projection which is opposite in orientation to the downhole profile. This opposite orientation creates a more efficient turbulent zone resisting the settlement of any other debris around the tool and raising more of the drill cuttings into the high annular zone, thereby keeping them in suspension. Any cuttings falling back radially towards the tubular and tending to re-form a cuttings bed will be accelerated again in a radially outward direction away form the tubular towards the high-flow region.

Embodiments of the invention permit sweeping and agitation of drill cuttings beds in a more aggressive manner allowing a cleaner hole.

The first and second axial impellers disposed at opposite ends of the radial impeller drive the cuttings in opposite axial directions to one another, so that when the pipe is rotated in its normal clockwise direction (as viewed from above) during conventional rotary drilling operations, the axial direction of thrust from each axial impeller urges the fluid and the cuttings inwardly towards the radial impeller. This tends to lock the cuttings in the region of the annulus between the two axial impellers, and because the axial impellers apply axial thrust in opposite directions to one another, the slug of drill cuttings trapped between them can be dragged out of the hole by continuing to rotate while pulling the string out. This technique works particularly well in horizontal sections of the well, and also has the benefit that bigger particles which sink more quickly and are more difficult to maintain in suspension can be dragged physically out of the well in the slug without necessarily holding them in suspension, rather than washing them out of the annulus while suspended in the fluid. At the very least, this locking and dragging feature can be used to move the slug of larger particles to a different section of the borehole, which may have a higher flow rate, for example a more vertical section of the well, where it may be easier to get the larger particles back into suspension for conventional recovery as a suspension.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention.

Various embodiments and aspects of the invention will now be described in detail with reference to the accompanying figures. Still other aspects, features, and advantages of the present invention are readily apparent from the entire description thereof, including the figures, which illustrates a number of exemplary embodiments and aspects and implementations. The invention is also capable of other and different embodiments and aspects, and its several details can be modified in various respects, all without departing from the spirit and scope of the present invention. Accordingly, the drawings and descriptions are to be regarded as illustrative in nature, and not as restrictive. Furthermore, the terminology and phraseology used herein is solely used for descriptive purposes and should not be construed as limiting in scope. Language such as "including", "comprising", "having", "containing" or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa.

All numerical values in this disclosure are understood as being modified by "about". All singular forms of elements, or any other components described herein are understood to include plural forms thereof and vice versa.

In the accompanying drawings:—

Figure 1:
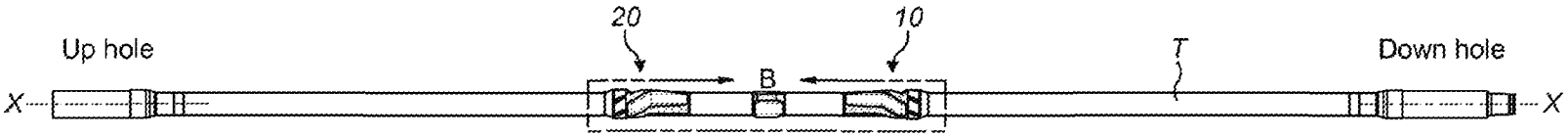
FIG. 1 is a side view of a drill string tubular component in accordance with the invention.
Figure 2:
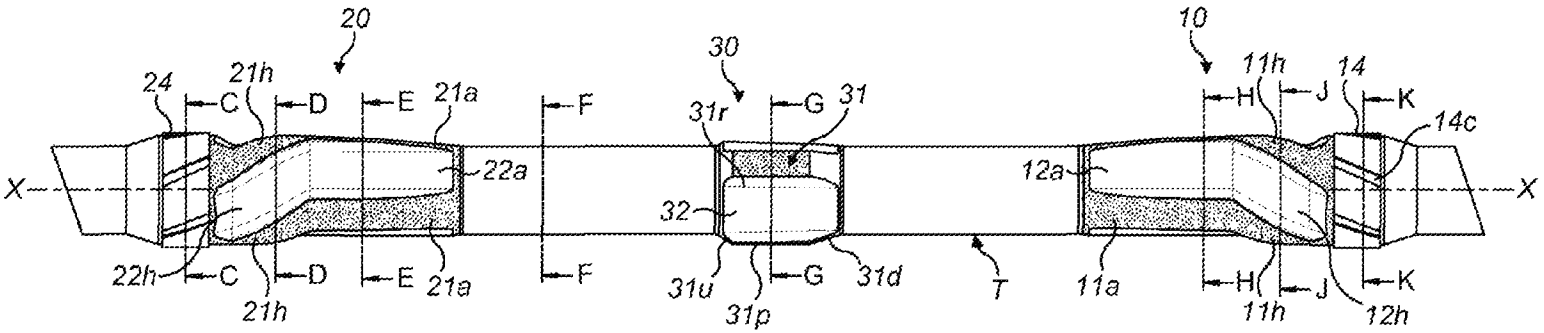
FIG. 2 is an enlarged side view of FIG. 1.
Figure 4:
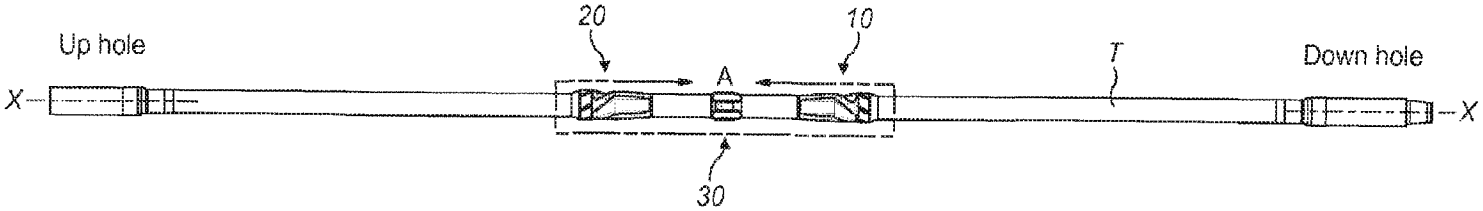
Figure 5:
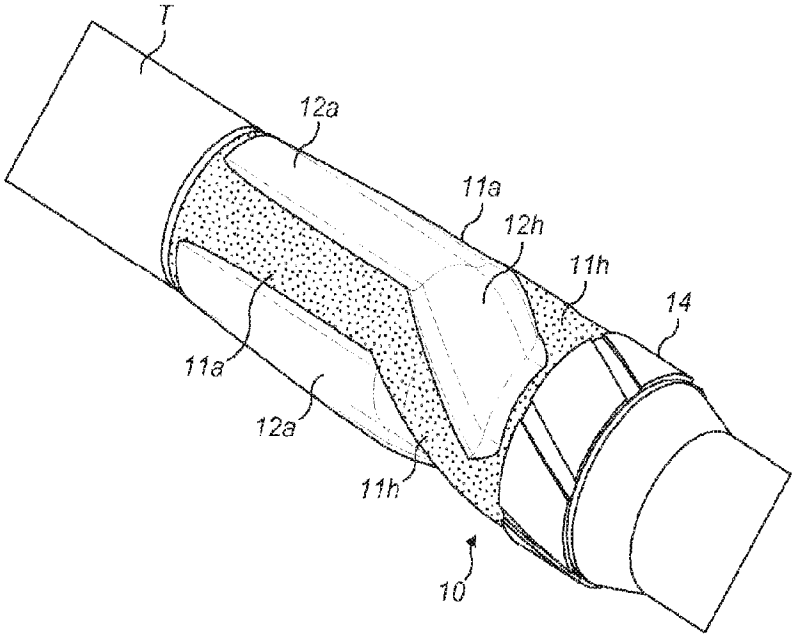
Figure 6:
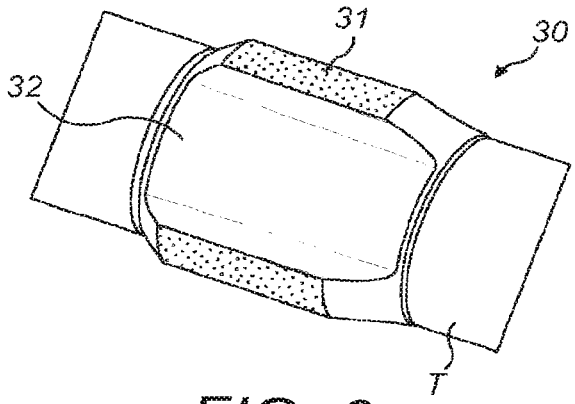
Figure 7:
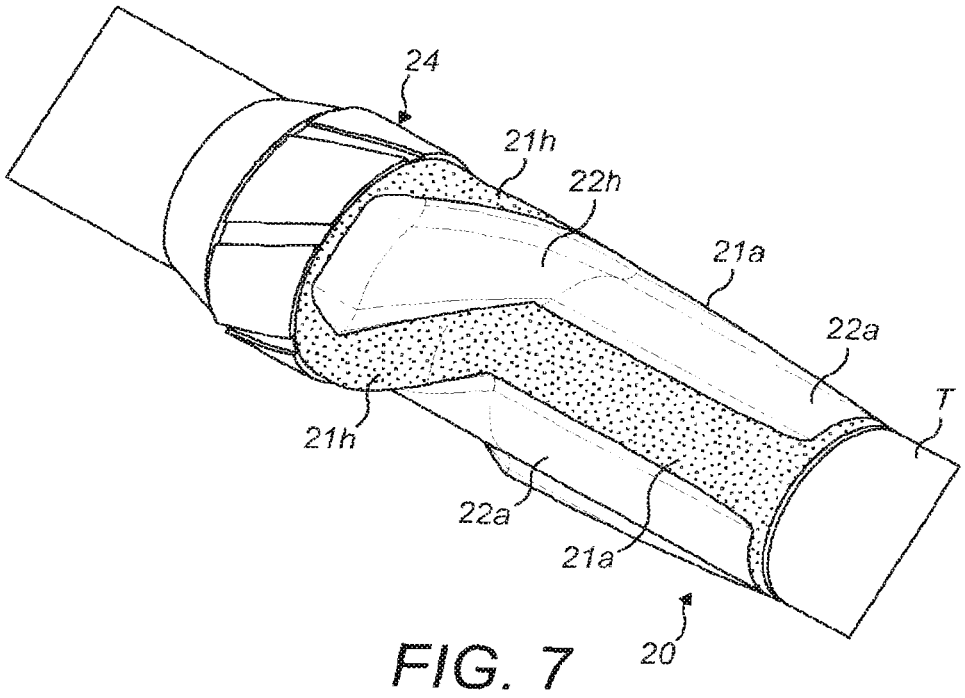
Figure 8:
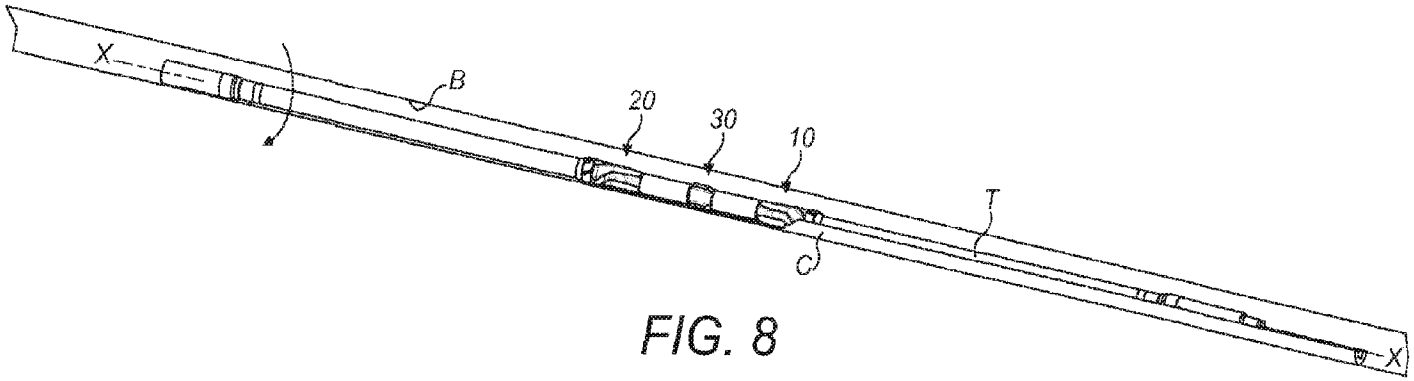
Figure 9:
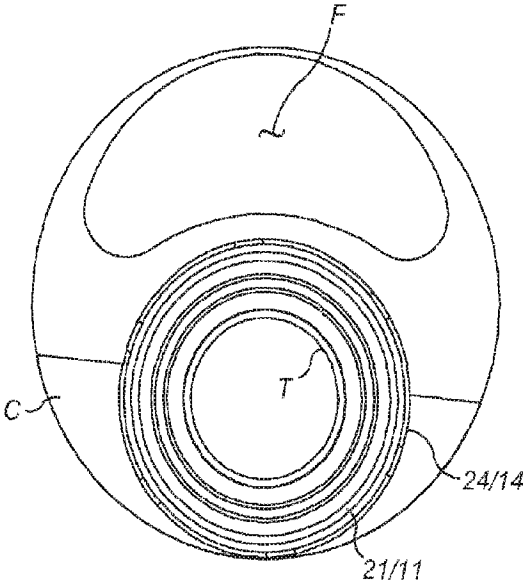
Figure 10:
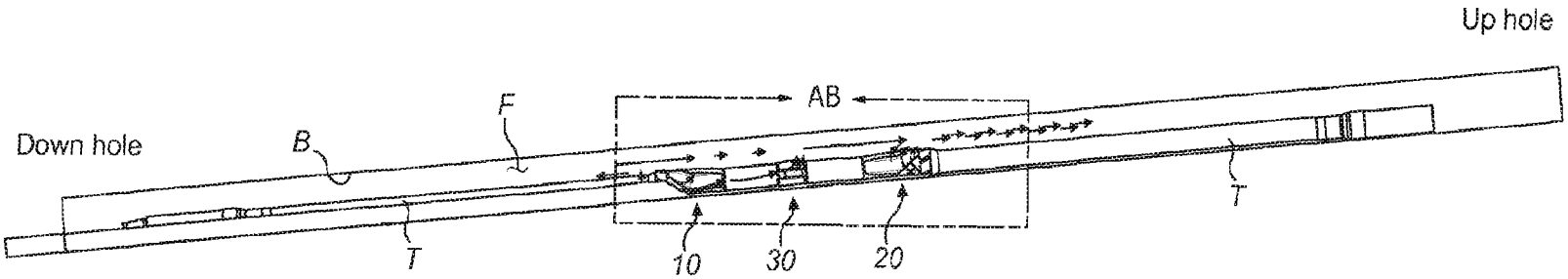
Figure 11:
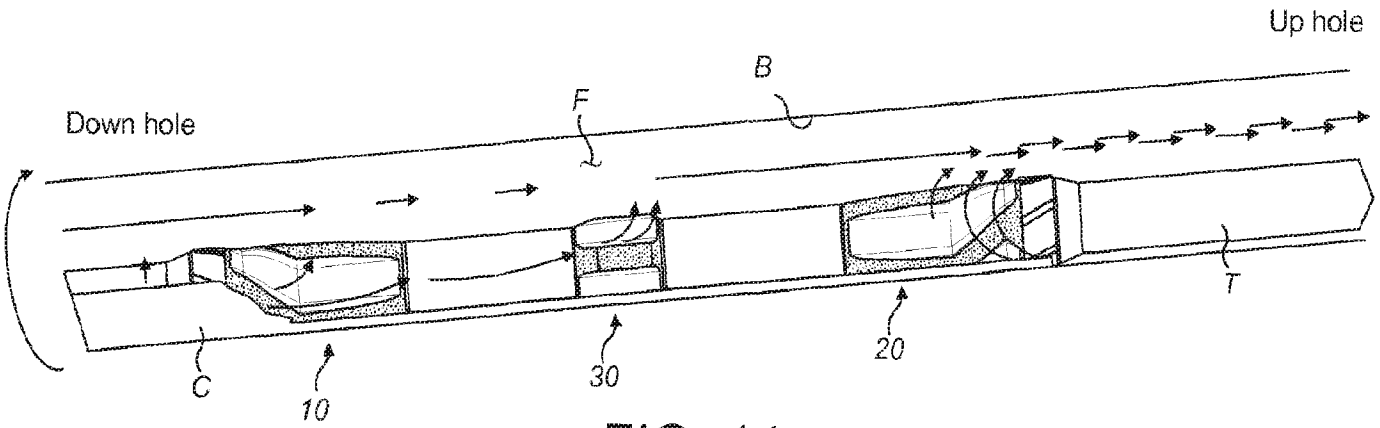

FIGS. 3*a-h* are sectional views through lines C-C, D-D, E-E, F-F, G-G-, H-H-. J-J- and K-K respectively of FIG. 2;

FIG. 4 is a side view similar to FIG. 1, but of the drill string tubular component turned through 60 degrees;

FIGS. 5, 6, and 7 are perspective views of axial and radial impeller collars of the FIG. 1 tubular component;

FIG. 8 is a side perspective view of the FIG. 1 tubular component being used in a drill string to mobilise cuttings in a wellbore;

FIG. 9 is an end view of the FIG. 8 arrangement;

FIG. 10 is a perspective view from the other side of the FIG. 8 arrangement showing the fluid flow; and FIG. 11 is a close up view of the FIG. 10 arrangement.

Referring now to the drawings, a drill string tubular member comprises a central tubular T having downhole and up-hole ends (see FIG. 1), and at those ends, typically has respective box and pin connectors for connection into a drill string. Typically the tubular is provided in a bottom hole assembly (BHA) adjacent to the drill bit, and the tubular T can optionally be heavy weight drill collar or heavy weight drill pipe, known for such uses. The box and pin connectors at the ends of the tubular T typically have a larger outer diameter than the nominal outer diameter of the tubular T in between the two ends. In the example shown, the nominal outer diameter of the central section of the tubular T is typically 5⅞". The tubular T typically comprises 5⅞" Heavyweight Drill Pipe.

On the outer surface of the tubular T, there are typically three collars that incorporate radial projections. At the downhole end, at least one first axial impeller is provided on a first collar 10. At the up-hole end, a second axial impeller is provided on a second collar 20. In between the first and second collars 10, 20, at least one radial impeller is provided by a third collar 30. The collars 10, 20, 30 can optionally be separately formed by machining from solid blocks for example and thereafter attached to the tubular T, or optionally can be formed as an integral part of the tubular T by machining the tubular and the collars from a single component. In the embodiment described, the collars 10, 20 and 30 are integrally formed with the tubular T.

Referring now to the first axial impeller provided by the first collar 10 at the downhole end of the tubular T, the collar 10 typically has three circumferentially spaced radial projections 11. More or less than three projections can optionally be provided. The radial projections extend radially away from the outer surface of the tubular T in a generally perpendicular direction. The radial projections 11 have an axial part 11*a*, which extends parallel to the axis of the tubular X (see FIG. 1), and a helical part 11*h*, which extends helically from the downhole end of the axial part, to which it connects. The helical part 11*h* extends in a clockwise direction when viewed from the up-hole end of the tool, which is commonly referred to in the art as extending in a "right hand" helix.

The collar 10 is generally frusto-conical and has a relatively small outer diameter at its up-hole end, which gradually increases towards its larger diameter downhole end. The radial projections 11 each have a generally convex radially outermost surface which tapers in a generally straight axial line in accordance with the frusto-conical shape of the collar 10, from its up-hole end to its downhole end, which has a larger diameter than its up-hole end. The up-hole end of the collar 10 tapers down to a generally similar outer diameter to the tubular T as do the flat outer surfaces of the radial projections 11.

The radial projections 11 are circumferentially spaced around the collar 10 as best shown in section views 3*f* and 3*g*. The side walls of the projections 11 are typically generally perpendicular to the axis of the tubular at the radially outermost edges of the projections, and typically change in angle as their radius decreases.

Circumferentially adjacent radial projections 11 define channels 12 between them. The channels 12 have an axial part 12*a* defined between adjacent axial parts 11*a* of the radial projections, and helical parts 12*h*, defined between helical parts of the radial projections. Therefore, the path of the channels 12 generally tracks the path of the radial projections 11 in the collar 10.

The channels 12 have a generally convex floor extending between the sides of the projections 11, as best shown in section views 3*f* and 3*g*; the floor typically follows the convex outer circumference of the tubular T, but in other embodiments of the invention the floor of the channel could be a different shape, e.g. convex or flat. In the axial direction, the floor of the channel can optionally be generally parallel to the axis of the tubular T. However, in alternative embodiments, the floor of the channel does not need to be parallel to the axis of the tubular T, but can adopt other configurations, for example the floor of the channel can optionally taper in the axial direction from the up-hole to the downhole end in a similar manner as the outer surface of the projections 11.

The circumferential transition between the floor of the channel and the generally perpendicular side walls of the radial projections 11 is typically in the form of a ramp, which optionally can be an arcuate ramp transitioning in a circumferential direction from a generally horizontal configuration at the floor level, to a generally vertical configuration as it meets the generally vertical side walls of the radial projections 11. Between the side walls of the projections 11 and the floor of the channel 12, the ramp can typically follow a smooth curve, although in certain configurations of the invention the ramp can be a graduated series of straight lines or steps. In the present embodiment, the transitional parts of the channel between the generally horizontal convex floor and the generally vertical side walls is in the form of a smooth concave curve. At the outer (downhole) end of the channel 12, the transition between the side walls of the projections 11 and the floor of the channel 12 typically merge together with the end wall of the channel 12 to form a bowl in the end of the channel 12. The end wall of the channel typically extends circumferentially in a straight line that is typically perpendicular to the axis of the tubular T. The transitions between the floor of the bowl and the side and end walls typically follows a smooth curve, although in certain configurations a graduated series of straight lines or steps can be adopted.

At the downhole end of the collar 10, beyond the bowl at the end of the channel 12, the outer diameter of the collar 10 increases in a step-wise manner at a wear strip 14. The wear strip 14 typically has channels 14*c* which extend helically in a right hand wrap through the wear strip 14, generally parallel to the channels 12 and radial projections 11 on the collar 10. The wear strip 14 can typically be faced with a hard wearing compound, such as polycrystalline material, or tungsten carbide etc, in order to resist abrasive damage during rotation of the tubular T. The wear strip 14 typically has a larger outer diameter (7½" in this example) than the other components of the collar 10, and functions as a stand off device that radially spaces the smaller diameter components of the collar 10 from the inner surface of the borehole wall in use.

The second axial impeller provided by the second collar 20 at the up-hole end of the tubular T is generally similar in structure to the first collar 10, but is typically arranged in an opposite orientation, typically in a mirror image relationship with the first collar 10. The second collar 20 also has three circumferentially spaced radial projections 21. It is possible in certain embodiments for the second collar 20 to have the same configuration as the first collar, but in this embodiment they are different. The radial projections 21 extend radially from the outer surface of the tubular T in a generally perpendicular direction. The radial projections 21 have an axial part 21*a*, which extends generally parallel to the axis of the tubular X (see FIG. 1), and a helical part 21*h*, which extends helically from the up-hole end of the axial part, to which it connects. The helical part 21*h* extends in an anti-clockwise direction when viewed from the up-hole end of the tool, or "left hand" helix, e.g. opposite to the helical parts 11*h* of the first collar 10. The second collar 20 is also generally frusto-conical and has a relatively small outer diameter at its downhole end, which gradually increases towards its larger diameter up-hole end. The radial projections 21 each have the same radially outermost surface which tapers in accordance with the frusto-conical shape of the collar 20, but in a different direction as compared with the first collar 10, from the downhole end to the up-hole end, which has a larger diameter than the downhole end. The downhole end of the collar 20 tapers down to a generally similar outer diameter to the tubular T as do the convex outer surfaces of the radial projections 21.

The radial projections 21 are typically circumferentially spaced around the collar 20 as best shown in section views 3*b* and 3*c*. The side walls of the projections 21 are typically generally perpendicular to the axis of the tubular at the radially outermost edges of the projections, and typically change in angle as their radius decreases.

Circumferentially adjacent radial projections 21 define channels 22 between them. The channels 22 have an axial part 22*a* defined between adjacent axial parts 21*a* of the radial projections, and helical parts 22*h*, defined between helical parts of the radial projections. Therefore, the path of the channels 22 generally tracks the path of the radial projections 21 in the collar 20, and forms a mirror image to the channels 12 in the first collar 10.

The channels 22 have a generally convex floor as best shown in section views 3*b* and 3*c*, which generally follows the convex outer circumference of the tubular T. In the axial direction, floor of the channel can optionally be generally parallel to the axis of the tubular T. However, in the present embodiment, the floor of the channel 22 is typically not absolutely parallel to the axis of the tubular T, but instead tapers in the axial direction from the downhole to the up-hole end in a similar manner as the outer surface of the collar 20, and in opposite relationship to the first collar 10.

The transition between the floor of the channel and the generally perpendicular side walls of the radial projections 21 is typically in the form of a ramp, which optionally can be an arcuate ramp transitioning from a generally horizontal configuration at the floor level, to a generally vertical configuration as it meets the generally vertical side walls of the radial projections 21. Between the side walls of the projections 21 and the floor of the channel 22, the ramp can typically be a smooth curve extending circumferentially, although in certain configurations of the invention the ramp can be a graduated series of straight lines or steps. In the present embodiment, the transitional parts of the channel between the flat floor and the vertical side walls is in the form of a smooth curve.

At the up-hole end of the collar 20, the outer diameter typically increases in a step-wise manner at a wear strip 24. The wear strip typically has channels 24*c* which extend helically in a left hand helix through the wear strip 24, generally parallel to the channels 22 and radial projections 21 on the collar 20. The wear strip 24 can typically be faced with a hard wearing compound, such as polycrystalline material, or tungsten carbide etc, in order to resist abrasive damage to the collars during rotation of the tubular T. The wear strip 24 typically has a larger outer diameter than the other components of the collar 20, and functions as a stand off device that radially spaces the smaller diameter components of the collar 20 from the inner surface of the borehole wall in use.

The third collar 30 is typically located between the first and second collars 10, 20, and is typically generally equidistantly located between the two. It should be noted that the axial impellers provided by the first and second collars can be omitted in certain embodiments of the invention, or alternatively, a single axial impeller can be provided, typically below the radial impeller provided on the third collar 30. The third collar 30 can typically be formed from a single unit, in a similar manner to the first collar, and subsequently attached. The third collar 30 can typically be milled or cast, as can the first and second collars 10, 20, or optionally can be formed from an integral part of the tubular T. In this example, the third collar 30 is formed as an integral part of the outer surface of the tubular T by milling, in a similar manner to the first and second collars 10, 20.

Optionally more than one third collar 30 can be provided between the downhole and up-hole first and second collars 10, 20. Optionally where more than one third collar is provided, the two third collars can be arranged in the same orientation or in opposite orientations with respect to one another.

The third collar 30 in the present example typically has an outer diameter of 7.25" at its widest point. The third collar 30 has three circumferentially spaced radial projections 31. The radial projections 31 are each formed from a downhole ramp 31*d*, an up-hole ramp 31*u*, and a plateau region 31*p* located between the downhole and up-hole ramps. Optionally the plateau region is non-parallel to the axis of the tubular T, and tapers from a narrower diameter at its downhole end to a slightly larger diameter at its up-hole end. The plateau region typically tapers between its downhole and up-hole ends at a taper angle of 1 or 2 degrees with respect to the axis of the tubular T. The projections 31 typically have a circumferential width of around 2", with an axial length of approx. 7.6".

Typically, the downhole ramp 31 has a tapered profile with an initial diameter at its downhole end close to the outer diameter of the tubular T, which gradually increases typically in a straight line to the plateau section 31*p*. In a similar manner, the up-hole ramp 31*u* typically decreases from its maximum outer diameter at its transition with the plateau section 31*p*, to a smaller diameter up-hole end of the ramp 31*u*, typically in a straight line, and typically to a smaller diameter that is substantially similar to the outer diameter of the tubular T. The radial projections 31 are circumferentially spaced in a generally equi-distanced manner from one another around the circumference of the collar 30, as best shown in FIG. 3*e*, and are typically aligned with the axis X of the tubular T. Between the circumferentially adjacent pairs of radial projections 31, a channel 32 is created. The channels 32 typically extend axially, parallel to the axis of the tubular X and the radial projections 31. The floor of the channel 32 is typically generally convex, similar to the convex outer surface of the tubular T, but in the axial direction the floor of the channel 32 is typically not parallel to the axis X of the tubular. Instead, the floor of the channel 32 typically tapers in the form of a ramp from a small outer diameter at its downhole end (typically the downhole outer diameter of the floor of the channel 32 approaches the nominal outer diameter of the tubular T). The up-hole end of the floor of the channel 32 therefore typically has a larger outer diameter than its downhole end, and the floor of the channel typically extends in a generally straight axial line between the downhole and up-hole ends, so that a convex ramp (or frusto-conical section) having a ramp angle of at least 1 degree with respect to the axis of the tubular T is created by the floor of the channel 32.

The circumferentially facing sides of the radial projections 31 on the third collar 30 are typically generally parallel to one another, and generally perpendicular to the axis X of the tubular T. Like the transitions between the sides and floor of the channels 12 in the first projection collar 10, the transitions between the floor of the channel 32 and the side walls of the radial projections 31 are typically in the form of a concave curve, as best seen in FIG. 3*e*.

Therefore, in a circumferential direction, the floor of the channel 32 typically transitions from its generally convex central floor section to a concave transition section having a smooth curve (or a series of flat plates or steps as previously described) merging into the generally vertical side walls of the radial projections 31.

In the current embodiment, the concave transitions can extend substantially for the whole radial depth of the side walls of the radial projections 31, and substantially only the radially outermost tip of the side walls can be perpendicular to the axis X.

As shown in the drawings, the first and second collars 10, 20 are of generally similar structure and are optionally in this embodiment set in opposite relationship to one another so that the helical parts of the projections 11, 21 and channels 12, 22 are set in opposite orientation with respect to one another. In use, and referring now to FIGS. 8-11, the tubular T is typically incorporated into a drill string close to the bottom hole assembly in a region where drill cuttings C are known to accumulate in beds. FIG. 8 shows a schematic view of the tubular T inserted in a generally deviated wellbore B, in which the drill cuttings C generated by the drill bit located below the tubular C in the wellbore B have accumulated in a bed of cuttings C on the low side of the wellbore B. The cuttings C are therefore not circulating freely within the wellbore B, and are impeding the downward progress of the drill string into the formation. The drill string is rotating in a clockwise direction when viewed from the top of the hole, in the direction of the arrow shown in FIG. 8. Note that FIGS. 10 and 11 show the opposite side of the tubular T, and so the direction of the arrow in FIG. 11 is different. Rotation of the drill string and tubular T in the clockwise direction shown in FIGS. 8 and 11 rotates all of the collars 10, 20, 30 along with the tubular T. At the downhole end, the helical part 11*h* of the radial projections 11 on the first collar 10 engages the cuttings C in the bed on the low side of the wellbore B and typically urges them by means of the helical channels 12*h* in an axial direction into and through the channel 12*h* and into the axial part of the channel 12*a* by virtue of the scooping effect of the helical parts 11*h*. The drill cuttings are therefore urged axially upwards in the wellbore B, in a direction generally parallel to the axis X of the tubular T and towards the third collar 30.

The drill cuttings C pass through the channels 32 between the radial projections 31 on the third collar 30 and as a result of the rotation of the collar 30 along with the tubular T, the drill cuttings passing through the channels 32 are engaged by the ramps on the side walls, and urged radially outwards from the collar 30 by the radial projections 31. The radial thrust imparted to the drill cuttings moves them away from the outer surface of the tubular and into the high flow high turbulence region F shown in FIGS. 9, 10 and 11. The concave transition ramp between the floor and the sides of the channel maintains much of the momentum of the drill cuttings as they change direction and ensures that they are diverted radially outward from the tubular with the maximum amount of radial thrust available. Drill cuttings that are diverted radially outward from the third collar 30 enter the fast flowing high turbulence region F and are thus quickly transported up the wellbore B, away from the bottom hole assembly. The drill cuttings diverted into the high flow region F in this manner have a higher chance of remaining in suspension in the drilling fluid, and a lower chance of settling out of suspension and creating a further cuttings bed in an up-hole region of the wellbore B.

The axial taper of the third collar 30 from a small diameter at its downhole end to a larger diameter at its up-hole end also diverts the cuttings towards the fast flowing fluid phase F, and imparts an additional radial thrust to the cuttings passing the third collar 30, which enhances the radial thrusting effect. Furthermore, the downhole and up-hole ramps 31*d*, 31*u* on the third collar also enhance the radial thrust effect of the third collar, ensuring that more of the cuttings encountering the ramps during the rotation of the drill string are urged radially away from the axis of the tubular into the faster flowing fluid.

Any cuttings that pass axially through the channels 32 without substantial radial diversion typically encounter the up-hole second collar 20 above the third collar 30. Drill cuttings encountering the second collar 20 flow up the axial channels 22*a* between the radial projections 21*a*, but when they encounter the helical parts 22*h* of the channels between the helical parts 21*h* of the radial projections, they are typically urged downward in the wellbore B against the predominantly upward flow as a result of the opposites orientation of the helical parts 21*h* on the second collar in relation to the helical parts 11*h* on the first collar 10. As the cuttings are urged by the second collar 20 against the predominant direction of flow, an excessive amount of turbulence is created in the region between the third collar 30 and the second collar 20, which tends to fluidise any drill cuttings in that region and urge them radially into the high flow area F as shown in FIGS. 10 and 11. Any drill cuttings that are urged axially down the wellbore B towards the third collar 30 as a result of the axial thrust provided by the radial parts 21*h* on the second collar 20 are diverted back towards the third collar 30 for further radial thrust, which also has the effect of ensuring that most of the cuttings C are maintained in suspension and thrust radially into the fast flowing fluid phase F. The steep angle on the uphole lead-in end of the third collar 30 has a more aggressive thrust effect on the fluids to accelerate cuttings that fall back towards the low side of the hole that have been recycled from the turbulent flow area between the second and third collars, and ensures that more of the cuttings reach the fast flow zone F and are maintained in suspension. The downhole lead in on the third collar has much shallower angle to help accelerate cuttings uphole from the lower first collar 10.

Modifications and improvements can be incorporated without departing from the scope of the invention.

The invention claimed is:

1. A drill string tubular component in the form of a tubular having a central bore extending along an axis of the tubular, and two ends, the tubular component having an end connector at each end for connection of the drill string tubular component into a drill string for use in drilling a wellbore into a formation, the tubular component having a mechanism for mobilising drill cuttings in an oil or gas well, wherein the mechanism comprises:

at least one radial impeller in the form of a radial projection extending from the tubular component, the radial projection being configured to apply a radial thrust to the flow of cuttings in the drilling fluid passing through the annulus between the tubular and the hole, so that the cuttings passing the radial projection are urged in a radial direction away from the outer surface of the tubular component; and first and second axial impellers in the form of radial projections extending radially from the tubular component, the first and second axial impellers being provided at axially spaced apart locations on the tubular component with respect to the radial impeller such that the radial impeller is located axially between the axial impellers, the axial impellers being configured to apply axial thrust to the fluids passing through the annulus between the tubular and the hole, and wherein the direction of axial thrust applied to the fluid by the first axial impeller is opposite to the direction of axial thrust applied to the fluid by the second axial impeller;

the first axial impeller being at a downhole end of the tubular component and having at least one helical part at its downhole end extending helically around the tubular component and at least one generally straight portion at its uphole end defining channels generally parallel to the longitudinal axis of the tubular component; and the second axial impeller being at an uphole end of the tubular component and having at least one helical part at its uphole end extending helically around the tubular component and at least one generally straight portion at its downhole end defining channels generally parallel to the longitudinal axis of the tubular component.

2. A drill string tubular component as claimed in claim 1, wherein each axial impeller urges the fluid toward the radial impeller for diversion in a radial direction away from the axis of the tubular component.

3. A drill string tubular component as claimed in claim 1, wherein each axial impeller has more than one helical part per impeller, and wherein the helical parts on each axial impeller are spaced circumferentially around the axis of the tubular, and are aligned with one another at the same axial location along the axis of the tubular component.

4. A drill string tubular component as claimed in claim 3, wherein the helical components on the first axial impeller extend in opposite directions with respect to the helical components on the second axial impeller.

5. A drill string tubular component as claimed in claim 2, wherein each of the axial and radial impellers comprises more than one radial projection, and wherein the radial projections are spaced circumferentially around the axis of the tubular component.

6. A drill string tubular component as claimed in claim 5, wherein the radial impeller has a ramp to divert fluids flowing axially up the annular area between the drill string and the wellbore radially away from the outer surface of the tubular component.

7. A drill string tubular component as claimed in claim wherein the radial impeller has at least one blade that extends radially from a root radially close to the outer surface of the tubular to a flat outer edge that is radially spaced from the axis of the tubular component.

8. A drill string tubular component as claimed in claim 7, wherein the radial impeller has more than one blade, and wherein the blades define fluid flow channels between circumferentially adjacent blades, wherein the fluid flow channels are adapted to guide flow of fluids in the annulus between the tubular component and the wellbore.

9. A drill string tubular component as claimed in claim 8, wherein the blades of the radial impeller are aligned with the axis of the tubular, and are straight, and wherein the channels between blades are also aligned with the axis of the tubular component and the blades, and are also straight.

10. A drill string component as claimed in claim 9, wherein the transition between the floor of the channels and the radially extending walls of the blades comprises an arcuate surface that extends between the sides of the blades and the floor of the channel, thereby creating a circumferentially facing ramp tapering perpendicularly with respect to the side walls of the blades.

11. A drill string component as claimed in claim 10, wherein the ramps on the side of the channels face the direction of rotation of the tubular, wherein fluid passing through the channels between the blades is urged up the ramps in a radial direction by the rotation of the radial impeller along with the rotating drill string to which the tubular component is attached, and is thus diverted radially outwards from the axis of the tubular component.

12. A drill string tubular component as claimed in claim 11, wherein the radial impeller has ramped surfaces on its uphole and downhole axial faces, and wherein the downhole end has a smaller diameter than the up-hole end, sufficient to divert the fluids flowing past or over the ramp (typically parallel to the axis of the tubular) radially outward from the axis of the tubular into a region of the annulus that has more turbulent flow than the region of the annulus immediately radially adjacent to the outer surface of the tubular component.

13. A drill string tubular component as claimed in claim 12, wherein the diameter of the ramp increases gradually between the axial ends of the ramp.

14. A drill string tubular component as claimed in claim 13, wherein the downhole axial ramp is arranged at its lower end, and tapers from a low radius to a high radius, and the uphole axial ramp is arranged at its uphole end, and tapers from a high radius to a low radius.

15. A drill string tubular component as claimed in claim 14, wherein the uphole ramp has a steeper angle with respect to the axis of the tubular component than the downhole ramp.

16. A drill string tubular component as claimed in claim 1, incorporating first and second bearing surfaces comprising a hardened material to bear against the inner surface of the wellbore, and to space the radial projections on the impellers from the inner surface of the wellbore.

17. A drill string tubular component as claimed in claim 16, wherein the first and second bearing surfaces are provided on the outer surfaces of first and second collars respectively located on opposite ends of the tubular component, adjacent to the respective first and second axial impellers.

18. A drill string tubular component as claimed in claim 16, wherein the bearing surfaces incorporate helical channels to channel fluid axially past the bearing, and wherein the channels on each bearing surface extend in a first direction on the first bearing surface, and in the opposite direction on the second bearing surface.

19. A method of mobilising drill cuttings in a bore of an oil or gas well, the method comprising incorporating a drill string tubular component into the drill string and deploying the drill string in the bore, the drill string tubular component having a mechanism for mobilising drill cuttings in the bore, wherein the mechanism comprises:

at least one radial impeller in the form of a radial projection extending from the drill string tubular component, the radial projection being configured to apply a radial thrust to the flow of cuttings in the drilling fluid passing through the annulus between the tubular component and the bore, so that the cuttings passing the radial projection are urged in a radial direction away from the outer surface of the tubular component, first and second axial impellers in the form of radial projections extending radially from the tubular component, the first and second axial impellers being provided at axially spaced apart locations on the tubular component with respect to the radial impeller such that the radial impeller is located axially between the axial impellers;

the first axial impeller being at a downhole end of the tubular component and having at least one helical part at its downhole end extending helically around the tubular component and at least one generally straight portion at its uphole end defining channels generally parallel to the longitudinal axis of the tubular component; and the second axial impeller being at an uphole end of the tubular component and having at least one helical part at its uphole end extending helically around the tubular component and at least one generally straight portion at its downhole end defining channels generally parallel to the longitudinal axis of the tubular component, wherein the method comprises:

passing fluids past the radial impeller and diverting fluids flowing past the radial impeller radially outwards away from the outer surface of the tubular component; and applying axial thrust to the fluids passing through the annulus between the tubular component and the bore by means of the axial impellers, wherein the direction of axial thrust applied to the fluid by the first axial impeller is opposite to the direction of axial thrust applied to the fluid by the second axial impeller.

20. A method according to claim 19, wherein the method includes rotating the tubular component to direct axial thrust from each axial impeller towards the radial impeller, and axially moving the tubular component in the bore to drag the cuttings axially within the bore whereby the drill cuttings are urged to remain in the region between the two axial impellers as a result of the opposed thrust from the axial impellers.

21. A method as claimed in claim 20, including moving a slug of drill cuttings from a first section of the bore with a first relatively low flow rate of fluid, to a different second section of the bore, which has a higher fluid flow rate than the first section of the bore, and suspending the drill cuttings in fluid in the second section of the bore for recovery at the surface as a suspension.

* * * * *